United States Patent [19]

Simms et al.

[11] Patent Number: 4,860,924

[45] Date of Patent: Aug. 29, 1989

[54] LIQUID DEVELOPER CHARGE DIRECTOR CONTROL

[75] Inventors: Robert M. Simms; George A. Gibson, both of Endwell, N.Y.; Benzion Landa, Edmonton, Canada

[73] Assignee: Savin Corporation, Stamford, Conn.

[21] Appl. No.: 224,231

[22] Filed: Jul. 25, 1988

Related U.S. Application Data

[63] Continuation of Ser. No. 154,497, Feb. 4, 1988, abandoned, which is a continuation of Ser. No. 829,618, Feb. 14, 1986, abandoned.

[51] Int. Cl.[4] ..... G03G 15/10

[52] U.S. Cl. ..... 222/56; 222/DIG. 1; 355/256; 118/689

[58] Field of Search ..... 355/10, 14 D, 14 CH; 354/323; 118/647, 689–691; 222/52, 54, 56, 132, 236, 255, DIG. 1

[56] References Cited

U.S. PATENT DOCUMENTS

| | | | |
|---|---|---|---|
| 3,129,115 | 4/1964 | Clark et al. | 355/10 X |
| 3,233,781 | 2/1966 | Grubbs et al. | 222/57 |
| 3,347,416 | 10/1967 | Hamilton | 222/134 X |
| 3,981,267 | 9/1976 | Gardiner et al. | 118/689 |
| 4,262,998 | 4/1981 | Kuehnle et al. | 355/10 |
| 4,310,238 | 1/1982 | Mochizuki et al. | 355/14 D |
| 4,331,184 | 5/1982 | Teroshima et al. | 141/94 |
| 4,370,053 | 1/1983 | Hirayama et al. | 355/14 D |
| 4,515,292 | 5/1985 | Koos, Jr. | 222/52 |
| 4,579,253 | 4/1986 | Shenier | 222/56 |
| 4,660,152 | 4/1987 | Downing et al. | 222/56 X |

FOREIGN PATENT DOCUMENTS

| | | | |
|---|---|---|---|
| 19538 | 2/1977 | Japan | 355/10 |
| 15956 | 1/1984 | Japan | 355/10 |
| 1253554 | 11/1971 | United Kingdom | 355/10 |

OTHER PUBLICATIONS

Patent Abstracts of Japan, Vol. 4, No. 156 (p. 34) 10-3-1-80 and JP A-55-103 570 (Canon K.K.) 7-8-80.

*Primary Examiner*—Michael S. Huppert
*Attorney, Agent, or Firm*—Kenyon & Kenyon

[57] ABSTRACT

A copier wherein charge director is supplied to a liquid developer in response to a conductivity measurement thereof. Toner concentrate deficient in charge director is supplied to the liquid developer in response to an optical transmissivity measurement thereof. Conductivity is measured by a pair of spaced electrodes immersed in the developer and through which a variable alternating current is passed. A variable capacitor neutralizes the inherent capacitance of the electrodes. A phase sensitive detector is provided with a reference voltage having the same phase shift as that caused by capacitive effects. The conductivity measurement is corrected in response to a developer temperature measurement.

20 Claims, 1 Drawing Sheet

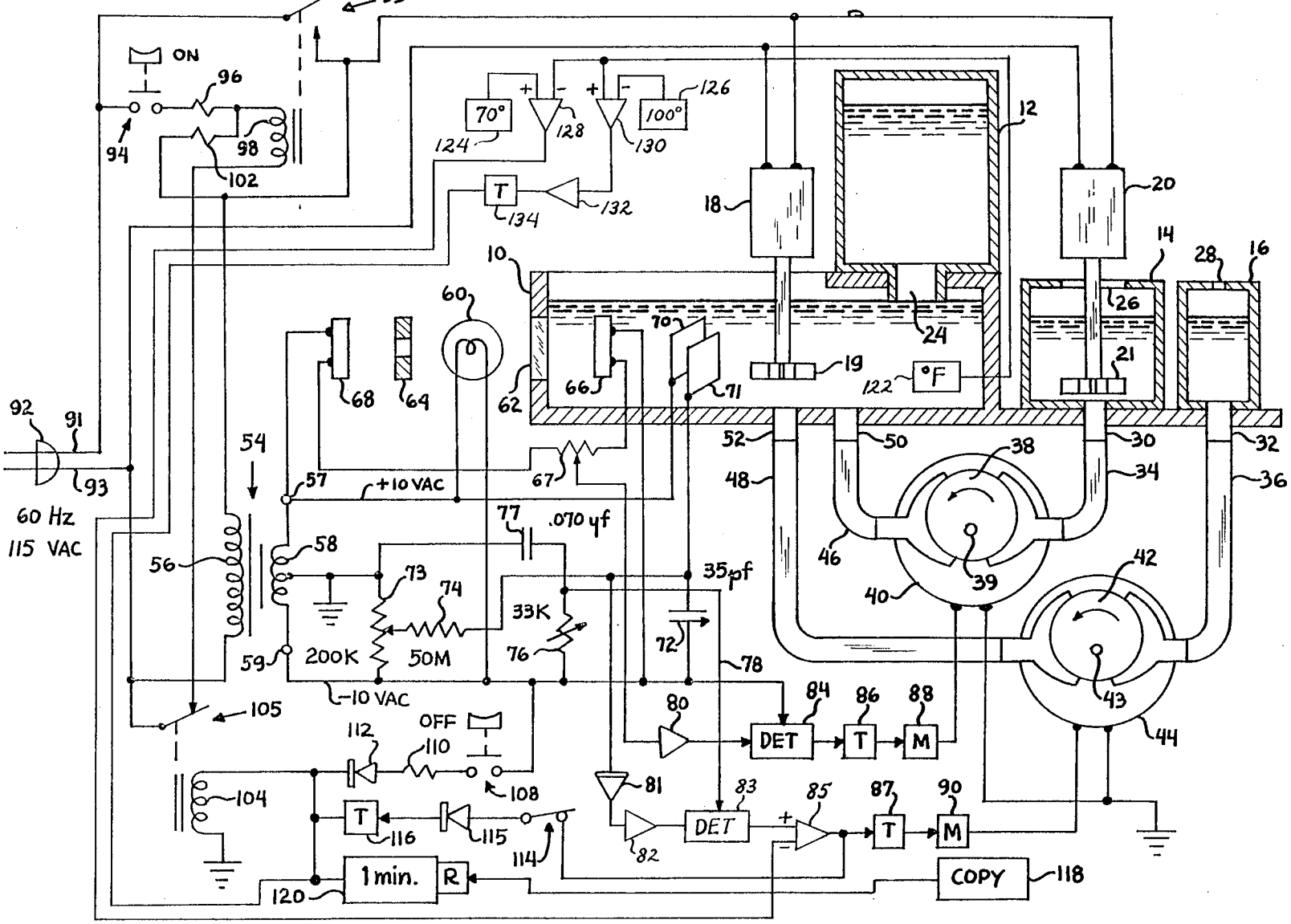
COPY
DET
DET
1 min.
ON
OFF
+10 VAC
-10 VAC
60 Hz
115 VAC
33K
50M
200K
.070 μf
35pf

LIQUID DEVELOPER CHARGE DIRECTOR CONTROL

This application is a continuation of Ser. No. 157,497, filed Feb. 4, 1988, now abandoned, which is a continuation of Ser. No. 829,618, filed Feb.14, 1986, now abandoned.

BACKGROUND OF THE INVENTION

Liquid developers generally include a liquid phase, comprising an insulating carrier liquid such as an isoparaffinic hydrocarbon, and a solid phase, comprising toner particles composed of a pigment and a binder. The solid phase toner is dispersed or suspended in the liquid phase carrier. Liquid developers further include a minor amount of charge director which insures that the toner particles are uniformly charged with the same polarity, which may be either positive or negative depending upon the particular application. The liquid developer is used to develop a latent image formed on a photoconductive imaging surface. Usually the photoconductive surface is charged with one polarity; and the toner particles are charged with an opposite polarity. If the liquid developer contains excessive charge director, then the images developed will tend to be somewhat faint because of loss of image charge due to leakage in the higher conductivity liquid developer. On the other hand if the liquid developer contains insufficient charge director, then the images developed will also tend to be somewhat faint since toner particles having reduced charge move with reduced velocity through the developer liquid to the imaging surface.

A more serious problem with liquid developers having insufficient charge director is that the toner tends to drop out of suspension, forming sludge deposits which continually grow until operation of the electrostatic copier must be interrupted for cleaning. It is the maintenance of the charge on the toner particles by the charge director which causes the toner particles to repel one another, maintaining them dispersed, and preventing them from agglomerating and forming sludge deposits

SUMMARY OF THE INVENTION

In general our invention contemplates a liquid developer control system wherein a liquid carrier, such as isodecane, from a first container is added to a diluted working developer suspension to maintain the volume of such working developer constant. The optical transmissivity of the working developer is measured; and toner concentrate from a second container is added to the working developer to maintain its optical transmissivity at a predetermined value. The conductivity of the working developer is also measured; and charge director concentrate from a third container is added to the working developer to maintain its conductivity at a predetermined value.

In the making of a copy with a liquid developer, a constant amount of carrier liquid is deposited over the entire surface of the copy sheet. This carrier liquid from the working suspension contains an associated amount of liquid phase charge director. There is further deposited upon the copy sheet an amount of toner proportional to the extent of printing on the copy sheet. This toner includes an associated amount of solid phase charge director. Accordingly, during the making of a copy, there is lost from the working developer a first constant quantity of charge director associated with the carrier liquid and a second variable quantity of charge director associated with the toner solids. The toner concentrate in the second container is preferably provided with a total amount of charge director not appreciably exceeding that associated with the solid phase toner. This prevents detectable sludging of the toner concentrate and insures that the toner concentrate can not cause the conductivity of the working developer to exceed its desired value. The charge director concentrate from the third container effectively supplies the charge director lost by transfer of carrier liquid to each copy sheet.

One object of our invention is to provide a liquid developer control system wherein a charge director concentrate is supplied to the working developer suspension in response to a conductivity measurement thereof.

Another object of our invention is to provide a liquid developer control system wherein a toner concentrate is added to the working suspension in response to a transmissivity measurement thereof.

Still another object of our invention is to provide a liquid developer control system wherein the toner concentrate contains a total amount of charge director not appreciably exceeding that associated with the solid phase toner.

A further object of our invention is to disable an electrophotocopier if the temperature of the liquid developer becomes excessive in order to prevent sludging.

A further object of our invention is to disable an electrophotocopier if the conductivity of the liquid developer drops appreciably below its proper value in order to prevent sludging.

Other and further objects of our invention will appear from the following description.

THE PRIOR ART

Gardiner et al 3,981,267 (Re. 30,477) uses a conductivity measurement of the liquid developer to control a constant current source providing biasing current to the development electrode.

Mochizuki et al 4,310,238 shows a liquid developer transmissivity control system, wherein the desired transmissivity value is modified by a measurement of the conductivity of the working suspension. More particularly, as the conductivity of the working suspension gradually increases during the making of many copies, the resulting "fatigue" of the developer is compensated for by adding more toner concentrate to decrease the transmissivity of the working developer.

BRIEF DESCRIPTION OF THE DRAWING

The accompanying drawing, which forms part of the instant specification and is to be read in conjunction therewith, is a schematic view of a preferred embodiment of our liquid developer charge director control.

DESCRIPTION OF THE PREFERRED EMBODIMENT

Referring now to the drawing, the working suspension is contained within a tank 10. A first container 12 having a neck 24 is provided with a supply of carrier liquid such as Isopar-G (a trademark of Exxon Corporation) which is a mixture of isoparaffinic hydrocarbons, largely isodecane, having a extremely low bulk conductivity. Container 12 is held inverted; and carrier liquid issues from neck 24 until the height of the working suspension in tank 10 covers the lower end of neck 24.

The working developer is relatively dilute and typically might be 1% toner solids and 99% carrier liquid by weight.

Within a second container 14 we provided a supply of toner concentrate. Typically the concentrate might be 10% toner solids by weight and 90% carrier liquid such as Isopar. The rate of sludging depends upon the temperature and the amount of charge director. Sludging is increased by temperature and is decreased by charge director. The sludging of the toner concentrate in container 14 is negligible compared with that of the working suspension in tank 10 because the concentrate is substantially at or only slightly above ambient or room temperature while the working suspension in tank 10 may approach temperatures as high as 100° F. Any local hot spots within tank 10 form sludging sites.

To further reduce any minimal sludging of the toner concentrate in the second container 14, we further provide the toner concentrate with a relatively large amount of charge director which, however, does not appreciably exceed that associated with the solid phase. Both toner solids and charge director associated therewith are removed from the system by transfer to copy paper and by sludging as well. Carrier liquid may be removed from the system both by transfer to copy paper and by evaporation. Both carrier liquid and charge director associated therewith are removed from the system by transfer to copy paper. However, evaporation of carrier liquid produces no loss in charge director. If the copier is maintained at operating temperature for an extended period of time and the sludging and evaporation rates are made up solely by toner concentrate from the second container 14, the amount of charge director within tank 10 will continually increase if the toner concentrate contains any charge director in excess of that associated with the toner solids. We ensure that the charge director control system will not lose control due to excessive charge director in tank 10 by ensuring that the charge director in the toner concentrate does not appreciably exceed that associated with the toner solids.

Within a third container 16 we provide a charge director concentrate which may contain 5% by weight of charge director and 95% carrier liquid such as Isopar. Electrophotocopiers employ a photoconductive surface which may be charged either positively or negatively. The charge director imparts a charge to the toner particles which is ordinarily opposite to that with which the photoconductive surface is charged. For example if the surface is charged positively, then a negative charge director would be employed both in the toner concentrate container 14 and in the charge director concentrate container 16. Such negative charge directors include metal salts of fatty acids such as calcium palmitate and metal salts of naphthenic acid such as barium petronate. If the photoconductive surface is negatively charged, then a positive charge director would be employed. Such positive charge directors include transition metal salts of fatty acids such as aluminum stearate and transition metal salts of naphthenic acid such as cobalt naphthanate. Further charge directors known to the prior art include sodium dioctyl sulfosuccinate, lecithin and calcium petronate, sometimes known as "mahogany soap". Generally we prefer charge directors which are soluble in the carrier liquid.

A shaded pole induction motor 18 drives a stirrer 19 within tank 10 to prevent settling of toner in the working suspension. A further shaded pole induction motor 20 drives a stirrer 21 which extends through a hole 26 in the top of the second container 14 to prevent settling of the toner in the concentrate The charge director concentrate container 16 is provided with an air hole 28 in the top thereof. The second container 14 is provided with a short outlet pipe 30 which is coupled by flexible tubing 34 to the inlet of a positive displacement pump 38 having an eccentric shaft 39 which is driven by a direct current motor 40. The outlet of pump 38 is connected by flexible tubing 46 to a short inlet pipe 50 of tank 10. The third container 16 is provided with a short outlet pipe 32 which is coupled by flexible tubing 36 to the inlet of a positive displacement pump 42 having an eccentric shaft 43 which is driven by DC motor 44. The outlet of pump 42 is coupled by flexible tubing 48 to a short inlet pipe 52 of tank 10. Positive displacement pumps 38 and 42 may be of the flexible vane type; and both the rotors thereof and motors 40 and 44 rotate counterclockwise in the direction of the arrows. Excitation of motor 40 drives pump 38, supplying toner concentrate from container 14 to tank 10. Excitation of motor 44 supplies charge director concentrate from container 16 to tank 10.

One wall of tank 10 is provided with a transparent plate 62, which permits light from an incandescent lamp 60 to pass therethrough to a photosensitive device 66 mounted within tank 10. Device 66 may comprise a photoconductor such as cadmium sulfide. The toner control may be substantially as shown in application Ser. No. 296,970 filed Aug. 27, 1981, for Improved Toner Control System, now Pat. No. 4,579,253. Light from lamp 60 is also directed through a variable or adjustable aperture 64 to a reference photosensitive device 68 which is similar to device 66. The primary winding 56 of a transformer indicated generally by the reference numeral 54 is excited by an alternating current source of, for example, 115 volts. Transformer 54 is provided with a secondary winding 58 having a center tap which is grounded Terminals 57 and 59 of winding 58 respectively provide +10 and −10 volts AC. Lamp 60 is connected between terminals 57 and 59. Terminal 57 is connected through device 68 to one terminal of a potentiometer 67, the other terminal of which is connected through device 66 to terminal 59. The slider of potentiometer 67 is connected through an AC amplifier 80 to the input of a phase sensitive detector 84 which receives a reference input from terminal 59. Positive outputs of detector 84 actuate a trigger circuit 86 which enables a free running power multivibrator 88. Multivibrator 88 is coupled to one terminal of motor 40, the other terminal of which is grounded.

Terminal 57 is connected to one electrode 70 of a pair of spaced electrodes 70 and 71 disposed within tank 10. Electrode 71 is connected through a 50 megohm resistor 74 to the slider of a 200 kilohm potentiometer 73 connected between terminal 59 and ground. Terminal 59 is connected through an adjustable capacitor 72 having a nominal value of 35 picofarads to electrode 71. Terminal 59 is further connected serially through a rheostat 76 having a nominal value of 33 kilohms and a 0.07 microfarad capacitor 77 to ground. Electrode 71 is connected to the gate of an insulatedgate field-effect transistor amplifier 81, which may comprise a source follower having a voltage amplification of substantially unity with an extremely high input impedance and a low output impedance. The source output of field effect transistor amplifier 81 is connected through an AC amplifier 82 to a phase sensitive detector 83, the reference input of which is supplied by a conductor 78 connected to the junction of rheostat 76 and capacitor 77. Detector 83 drives the positive input of a unity gain differential amplifier 85. Positive outputs of amplifier 85 actuate a trigger circuit 87 which enables a free running power multivibrator 90. Multivibrator 90 is connected to one terminal of motor 44, the other terminal of which is grounded.

A wall plug 92 provides a source of 115 volts AC at 60 Hertz. Conductor 93 of plug 92 is connected to one terminal of primary winding 56 and to the armature of a normally closed relay switch 105 which may be opened by energization of a DC relay winding 104. Conductor 93 is further connected to one terminal of each of stirring motors 18 and 20. Conductor 91 of plug 92 is connected to the armature of a normally open relay switch 99 which may be closed by energization of an AC relay winding 98. The fixed contact of relay switch 99 is connected to the other terminal of each of stirring motors 18 and 20, to the other terminal of primary winding 56, and through a resistor 102 to one terminal of relay winding 98. The other terminal of winding 98 is connected to the fixed contact of relay switch 105. Conductor 91 is connected to one contact of a spring-loaded normally-open "on" switch 94. The other contact of switch 94 is connected through a resistor 96 to the first terminal of winding 98. The fixed contact of relay switch 99 also provides power to the copier as is well-known to the art.

Terminal 59 is connected to one contact of a spring-loaded, normally-open "off" switch 108. The other contact of switch 108 is connected through a resistor 110 and forwardly through a diode 112 to a first terminal of relay winding 104 &he other terminal of which is grounded. The output of amplifier 85 is connected through a normally closed, manually-operable switch 114 and forwardly through a diode 115 to the input of a trigger circuit 116. The output of trigger circuit 116 is connected to the first terminal of relay winding 104. Upon the making of each copy, an output is provided by circuit 118 which is coupled to the resetting input of a one minute timer 120. The output of timer is connected to the first terminal of relay winding 104.

The temperature of the working suspension is measured by a sensor 122 providing an electrical output scaled, for example, in degrees Fahrenheit. The output of temperature sensor 122 is applied to the negative input of a unity gain differential amplifier 128 and to the positive input of a unity gain differential amplifier 130. A source of a fixed voltage 124 scaled to represent ambient or room temperature of 70° F. is applied to the positive input of differential amplifier 128. A source of a fixed voltage 126 scaled to represent a temperature of 100° F. is applied to the negative input of differential amplifier 130. The output of differential amplifier 128 is applied to the negative input of differential amplifier 85. The output of differential amplifier 130 is applied through an amplifier 132 to a trigger circuit 134, the output of which is connected to the first terminal of relay winding 104.

In operation of our invention, the "on" switch 94 is momentarily closed which, through resistor 96, energizes relay winding 98, the circuit being completed through switch 105. Relay switch 99 closes, applying power from conductor 91 through resistor 102 to winding 98, maintaining it energized. The closing of switch 99 also excites stirring motors 18 and 20, energizes primary winding 56, and provides power to the copier through other connections not shown.

In operation of the toner control system, adjustable aperture 64 causes the amount of light falling on device 68 to be equal to that passing through window 62 and falling upon device 66 when the working suspension has the desired transmissivity. In such event, equal voltage drops occur across devices 66 and 68; and the input of amplifier 80 is at ground potential. Potentiometer 67 is adjusted to compensate for slight mismatch in devices 66 and 68. As the transmissivity of the working developer increases due to depletion of toner, more light falls upon device 66, reducing its resistance. An AC voltage appears at the input of amplifier 80 which is in phase with that at terminal 59. Phase sensitive detector 84 now provides a positive output. When such output exceeds +0.5 volt, for example, trigger circuit 86 is actuated, causing multivibrator 88 to excite motor 40 with a duty cycle of, for example, one second "on" and four seconds "off". During each one second interval that motor 44 is excited, it rotates counterclockwise, correspondingly driving pump 38 and supplying toner concentrate from container 14 to tank 10. The four second interval between successive excitations of motor 40 permits stirrer 19 to circulate the toner concentrate throughout the working suspension. As the transmissivity of the working suspension decreases due to increase in amount of toner, the output of detector 84 decreases; and at zero volts, for example, trigger circuit 84 is turned "off", disabling multivibrator 88 and motor 40.

Charge director in the working suspension is depleted not only by transfer of carrier liquid to a copy sheet but also by loss of toner due either to transfer thereof to a copy sheet or to sludging thereof within tank 10. Electrodes 70 and 71 may be formed as parallel plates or as concentric cylinders having respective diameters of 0.55 inch and 0.45 inch with lengths of approximately 2.5 inches. The spacing between the cylinders may thus be approximately 0.05 inch. The area between spaced electrodes 70 and 71 is approximately 3.9 square inches. The working suspension may have optimum performance with a bulk conductivity of 50 picohos per centimeter, for example. This produces a resistance between electrodes 70 and 71 of approximately 100 megohms. The input to amplifier 81 will be at ground potential with the slider of potentiometer 73 positioned substantially at its midpoint and providing −5 VAC. Potentiometer 73 acts as a variable potential source having a maximum internal resistance, when positioned at its midpoint, of 50 kilohms which is one-thousandth the 50 megohms resistance of fixed resistor 74.

The conductance between the parallel plates or concentric cylinders 70 and 71 is proportional to the surface area and inversely proportional to the spacing therebetween. The same relationship also prevails for the capacitance between the plates or cylinders 70 and 71. Isopar-G has a dielectric constant of 2.0; and the capacitance between plates 70 and 71 is approximately 35 picofarads. At a frequency of 60 Hertz, the capacitive reactance between plates 70 and 71 is 75 megohms. Capacitor 72, having a nominal value of 35 picofarads, is adjusted to equality with the capacitance of plates 70 and 71, so that the input to amplifier 81 can have zero quadrature component. The equivalent capacitance of plates 70 and 71 and capacitor 72 is 70 picofarads which at a frequency of 60 Hertz has a capacitive reactance of 37.5 megohms. This is shunted by the 33.3 megohms equivalent resistor of resistor 74 and plates 70–71.

As the conductivity of the working suspension in tank 10 decreases due to the depletion of charge director, the resistance between plates 70 and 71 increases. In the absence of capacitive effects, this would produce an AC voltage at the input of amplifier 81 which is in phase with that of the −10 VAC potential at terminal 59. Because of the capacitive effect of plates 70–71 and neutralizing capacitor 72, the voltage at the input of amplifier 81 lags that at terminal 59 by arctan (33.3/37.5) $=\tan^{-1}0.89=41.6°$ . Capacitor 77 has a value which is approximately a thousand times the 70 picofarad equivalent capacitance of plates 70–71 and capacitor 72; and resistor 76 has a nominal resistance which is one-thousandth that of the 33.3 megohm equivalent resistance of plates 70-71 and resistor 74. Resistor 76 is adjusted so that the reference voltage on conductor 78 lags that at terminal 59 by 41.6°. Small errors in the adjustment of capacitor 72 produce at the input of amplifier 81 only voltage components in quadrature with the reference signal on conductor 78 provided to detector 83. Accordingly, detector 83 will produce no voltage output. However, increase in the resistance between plates 70 and 71, due to decrease in the conductivity of the working suspension, produces at the input of amplifier 81 a voltage component in phase with the reference signal provided to detector 83 on conductor 78. Phase sensitive detector 83 now produces a positive output. We prefer AC conductance measurement, despite capacitive effects, to prevent any net deposition of toner on electrodes 70 and 71, as would occur if DC potentials were applied thereto.

The working suspension has a positive temperature coefficient of bulk conductivity which may, for example, be 0.5 picomho per centimeter per degree Fahrenheit. At a temperature of 100° F. the same optimum performance working suspension may thus have a increased bulk conductiyity of $50+0.5\ (100-70)=65$ picomhos per centimeter. As the temperature of the working suspension increases above 70° F., the output of differential amplifier 128 becomes negative. The increased bulk conductivity of the working suspension produces a negative output from detector 83. The gradient in volts per ° F. of sensor 122 and the gain of amplifier 82 should be such that the negative outputs of both amplifier 128 and detector 83 are substantially equal, so that no output is produced from differential amplifier 85 as long as the composition of the working suspension does not change, irrespective of changes in its temperature. The conductivity measurement is thus modified by correcting for changes in conductivity caused by variations in developer temperature from 70° F. As the amount of charge director in the working developer composition gradually decreases, the output of amplifier 85 gradually increases.

When the output of amplifier 85 exceeds +0.5 volt, for example, trigger circuit 87 is actuated, causing multivibrator 90 to excite motor 44 with a duty cycle of, for example, one-quarter second "on" and five seconds "off". Pump 42 may have one-fifth the volume or displacement of pump 38. The amount of charge director concentrate to be added is extremely small. The five seconds "off" interval permits stirrer 19 to thoroughly mix the added charge director with the working suspension. During each one-quarter second interval that motor 44 is excited, it drives pump 42 counterclockwise, supplying charge director from the third container 16 to tank 10. As the conductivity of the working developer increases, the output of amplifier 85 decreases; and at zero volts, for example, trigger circuit 87 is turned "off", disabling multivibrator 90 and motor 44.

The following examples of working developer and toner concentrate are given by way of illustration and not by way of limitation. A 1% working developer suspension may comprise 990 grams of Isopar-G and 10 grams of toner solids including pigment and binder. Optimum performance may be at a conductivity of 50 picomhos per centimeter at 70° F. which may require 238 milligrams of a given charge director. The loss of each gram of toner solids, whether by transfer to a copy sheet or by sludging within tank 10, may remove 4 milligrams of charge director. Each gram of carrier liquid transferred to a copy sheet may remove 0.2 milligram of charge director. The 10 grams of toner solids requires $4\times10=40$ milligrams of charge director; the Isopar carrier requires $990\times0.2=198$ milligrams of charge director; and the total amount of charge director is $40+198=238$ milligrams. A 10% toner concentrate may contain 100 grams of toner solids, including pigment and binder, and 900 grams of Isopar-G. The toner concentrate preferably further includes 4 milligrams of charge director associated with each gram of toner solids, or $4\times100=400$ milligrams of charge director, to prevent sludging. However, the toner concentrate preferably contains little or no further charge director associated with the 900 grams of Isopar. The toner concentrate is thus deficient by $900\times0.2=180$ milligrams of charge director to ensure that the system cannot lose control. The carrier liquid in the first container 12 is also deficient in charge director since preferably little or none is provided therein. All further charge director needs are supplied from the charge director concentrate in the third container 16.

To turn the copier off, the spring-loaded, manually-operable "off" switch 108 is momentarily depressed, supplying DC current through resistor 110 and rectifier 112 to winding 104. Engerization of winding 104 opens switch 105, disabling the circuit for winding 98. Switch 99 thus opens, removing power from the copier. The copier also turns itself off automatically if no copies are made for a period of one minute. As long as copies are being made more frequently than once each minute, the copy sensor 118 will reset the one minute timer 120 before it provides an output. However, if no copy is made for a period exceeding one minute, then the copy sensor 118 will not reset timer 120 before its timing interval has expired. When the one minute timing interval of timer 120 expires, an output signal is produced which energizes winding 104, opening switch 105 and disabling the circuit for winding 98. Switch 99 now opens, removing power from the copier.

When the conductivity control system is operating normally, the output from amplifier 85 will gradually increase from zero volts to approximately 0.5 volt, whereupon charge director concentrate is added until the output of amplifier 85 drops back to zero volts again. If the third container 16 is empty of charge director concentrate, or if there is a failure in trigger circuit 87, multivibrator 90, motor 44, or pump 42, then the output from amplifier 85 will gradually increase beyond 0.5 volt. Diode 115 may be formed of silicon and requires approximately 0.5 volt of forward bias for conduction. The input of trigger circuit 116 now begins to rise from ground potential. When the output of amplifier 85 exceeds +1.0 volt, the input of trigger circuit 116 exceeds +0.5 volt, thereby actuating it and energizing winding 104. Relay switch 105 opens, disabling the circuit for winding 98. This opens switch 99, removing power from the copier. While the copier may be momentarily turned "on" by depressing switch 94, it will immediately thereafter be turned "off" by amplifier 85 through switch 114, diode 115, trigger circuit 116, and winding 104, which opens switch 105. It is desired that the copier not be permitted to operate with significantly less charge director in the working developer than that required to bring the system to optimum performance. Significantly reduced amounts of charge director would lead to more rapid sludging of toner in tank 10, resulting not only in loss of toner material but also more frequent maintenance.

Generally operation of the copier can be restored by providing a fresh supply of charge director concentrate in container 16. However, the output of amplifier 85 still exceeds +1.0 volt. To prevent this output of amplifier 85 from turning "off" the copier, switch 114 is opened. The input of trigger circuit 116 drops to ground potential, turning "off" trigger 116, and disabling relay winding 104. Motor 44 now causes charge director concentrate to be pumped from container 16 into tank 10. When the output of amplifier 85 drops below +1.0 volt, switch 114 may be closed. Trigger circuit 116 will not be turned "on", since its input is less than +0.5 volt. Charge director concentrate will continue to be pumped until the output of amplifier 85 drops to ground potential, turning "off" trigger circuit 87.

The copier normally operates with developer temperatures less than 100° F., where the sludging rate is acceptably small. If, for example, a cooling fan fails, then the developer temperature will rise above 100° F. The output of differential amplifier 130 will become positive and, through amplifier 132, actuate trigger circuit 134. This energizes winding 104, turning "off" the copier and preventing any further rise in developer temperature or increase in sludging rate.

It will be seen that we have accomplished the objects of our invention. We have provided a system for independently controlling the quantity of carrier liquid, the quantity of of toner solids and the quantity of charge director in a working liquid developer. The height or volume of carrier liquid is controlled by the neck 24 of container 12. The quantity of toner concentrate is governed by a balanced transmissivity measuring system wherein equal amounts of light fall upon matched photosensitive devices. The quantity of charge director concentrate is governed by an alternating current conductivity measurement wherein the inherent capacitance between the conductivity measuring electrodes is compensated for by a balanced circuit employing a phase sensitive detector. To prevent either sludging of the toner concentrate or loss of control of the charge director control system, the toner concentrate contains a total amount of charge director which does not appreciably exceed that associated with the toner solids and contains little or no charge director associated with the carrier liquid component. Our system exhibits none of the so called "fatigue" effects of prior art systems which supply excessive charge director with the toner concentrate. In such systems, the conductivity of the working developer gradually increases, causing an excessive discharge rate of the photoconductive surface and the latent image thereon. To prevent excessive sludging of the working suspension when the charge director concentrate is exhausted or the control system fails, the copier is automatically turned off; and further operation is inhibited. The copier is further disabled if the temperature of the working suspension rises above a point where the sludging rate is still acceptably small. The conductivity measurement is modified by correcting for changes in developer conductivity caused by changes in its temperature.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is therefore to be understood that our invention is not to be limited to the specific details shown and described.

Having thus described our invention, what we claim is:

1. A liquid developer control system including in combination a first source of carrier liquid, a second source of toner, a third source of charge director, a working supply of liquid developing means for supplying carrier liquid from the first source to the liquid developer, first means for measuring the optical transmissivity of the liquid developer, means responsive to the first means for supplying toner from the second source to the liquid developer, second means for measuring the conductivity of the liquid developer, and means responsive to the second means for supplying charge director from the third source to the liquid developer.

2. A system as in claim 1 wherein the first means includes a pair of matched photosensitive devices receiving substantially equal amounts of light from a common light source when the developer liquid has the desired transmissivity, one device responding to source light transmitted through the liquid developer.

3. A system as in claim 1 further including means for agitating the liquid developer.

4. A system as in claim 1 wherein the third source includes a charge director concentrate comprising charge director and carrier liquid, the concentration of charge director in the charge director concentrate being much greater than the concentration of charge director in the liquid developer.

5. A system as in claim 1 wherein the second source includes a toner concentrate comprising toner dispersed in carrier liquid, the concentration of toner in the toner concentrate being much greater than the concentration of toner in the liquid developer.

6. A system as in claim 5 wherein the liquid developer includes a first amount of charge director associated with the toner and a second amount of charge director associated with the carrier liquid, and wherein the toner concentrate includes a total amount of charge director not appreciably in excess of that amount of charge director associated with the toner.

7. A system as in claim 5 further including means for agitating the toner concentrate.

8. A control system for a liquid developer comprising carrier liquid and toner and charge director components including in combination means for measuring the conductivity of the liquid developer and means responsive to the measuring means for controlling the charge director component of the liquid developer independently of the toner component.

9. A system as in claim 8 wherein the charge director component is soluble in the carrier liquid component.

10. A control system as in claim 8 wherein the means for measuring the conductivity of the liquid developer comprises in combination a pair of spaced electrodes, the space therebetween being filled with liquid developer, a variable alternating voltage source, means correcting one terminal of the source to one electrode, a resistor, and means including the resistor connecting the other electrode to the other terminal of the source.

11. A system as in claim 10 wherein the resistor is fixed.

12. A control system for a liquid developer comprising carrier liquid and toner and charge director components including in combination a pair of spaced electrodes, the space therebetween being filled with liquid developer, said electrodes having a certain conductance and a certain capacitance therebetween, an alternating voltage source, means connecting one terminal of the source to one electrode, a capacitor having a value approximately equal to said certain capacitance, means including the capacitor for connecting the other electrode to the other terminal of the source, and means responsive to the voltage at said other electrode for controlling one of said components.

13. A system as in claim 12 wherein the capacitor is adjustable.

14. A control system for a liquid developer comprising carrier liquid and toner and charge director components including in combination a pair of spaced electrodes, the space therebetween being filled with liquid developer, a first alternating voltage source, means connecting one terminal of the first source to one electrode, a capacitor, means including the capacitor for connecting the other electrode to the other terminal of the first source, a variable alternating voltage source, a resistor, means including the resistor for connecting said other electrode to one terminal of the variable source, means connecting the other terminal of the variable source to said other terminal of the first source, and means responsive to the voltage at said other electrode for controlling one of said components.

15. A system as in claim 14 wherein the resistor is fixed.

16. A system as in claim 14 wherein the capacitor is adjustable.

17. A control system for a liquid developer comprising carrier liquid and toner and charge director components including in combination a pair of spaced electrodes, the space therebetween being filled with liquid developer, an alternating voltage source, means connecting the source to one electrode, a phase sensitive detector having a signal input and a reference input, means connecting the other electrode to the signal input, means for providing a voltage having a predetermined phase shift other than 0° or 180° relative to said source, means applying said voltage to the reference input, and means responsive to the phase sensitive detector for controlling one of said components.

18. A control system for a liquid developer comprising carrier liquid and toner and charge director components including in combination means responsive to the optical transmissivity of the developer for controlling the toner component and means responsive to the conductivity of the developer for controlling the charge director component independently of the toner component.

19. In a control system for a liquid developer comprising carrier liquid and toner and charge director wherein a first amount of charge director is associated with the toner and a second amount of charge director is associated with the carrier liquid, a toner concentrate including toner dispersed in carrier liquid, the concentration of toner in the toner concentrate being much greater than the concentration of toner in the liquid developer, the toner concentrate further including a total amount of charge director not appreciably in excess of that amount of charge director associated with the toner, whereby said toner concentrate is deficient in charge director.

20. A control system for a liquid developer comprising carrier liquid and toner and charge director components including in combination means for providing a conductivity measurement of the liquid developer, means for providing a temperature measurement of the liquid developer, means responsive to the temperature measurement for modifying the conductivity measurement, and means responsive to the modified conductivity measurement for controlling one of said components.

* * * * *